US011304003B2

(12) United States Patent
Christoph et al.

(10) Patent No.: US 11,304,003 B2
(45) Date of Patent: Apr. 12, 2022

(54) LOUDSPEAKER ARRAY

(71) Applicant: Harman Becker Automotive Systems GmbH, Karlsbad (DE)

(72) Inventors: Markus Christoph, Straubing (DE); Matthias Kronlachner, Regensburg (DE)

(73) Assignee: Harman Becker Automotive Systems GmbH, Karlsbad (DE)

( * ) Notice: Subject to any disclaimer, the term of this patent is extended or adjusted under 35 U.S.C. 154(b) by 780 days.

(21) Appl. No.: 16/067,924

(22) PCT Filed: Dec. 14, 2016

(86) PCT No.: PCT/EP2016/081014
§ 371 (c)(1),
(2) Date: Jul. 3, 2018

(87) PCT Pub. No.: WO2017/118552
PCT Pub. Date: Jul. 13, 2017

(65) Prior Publication Data

US 2020/0275231 A1 Aug. 27, 2020

(30) Foreign Application Priority Data

Jan. 4, 2016 (EP) ..... 16150043

(51) Int. Cl.
*H04R 3/12* (2006.01)
*G09G 5/00* (2006.01)
(Continued)

(52) U.S. Cl.
CPC ..... *H04R 3/12* (2013.01); *G09G 5/003* (2013.01); *H04R 1/403* (2013.01); *H04R 5/02* (2013.01);
(Continued)

(58) Field of Classification Search
CPC combination set(s) only.
See application file for complete search history.

(56) References Cited

U.S. PATENT DOCUMENTS 5,831,977 A 11/1998 Dent
6,741,273 B1 5/2004 Waters et al.
(Continued)

FOREIGN PATENT DOCUMENTS

CN 1741601 A 3/2006
CN 1898988 A 1/2007
(Continued)

OTHER PUBLICATIONS

Tourbabin et al., "Optimal Real-Weighted Beamforming With Application to Linear and Spherical Arrays", IEEE Transactions on Audio, Speech, and Language Processing, vol. 20, No. 9, Nov. 2012, pp. 2575-2585.
(Continued)

*Primary Examiner* — Duc Nguyen
*Assistant Examiner* — Assad Mohammed
(74) *Attorney, Agent, or Firm* — Brooks Kushman P.C.

(57) ABSTRACT

At least two closely spaced identical or similar loudspeaker assemblies in a horizontal linear array, each loudspeaker assembly comprising at least two identical or similar loudspeakers pointing in different directions so that the loudspeaker assemblies have adjustable, controllable or steerable directivity characteristics. For example, a control module may drive, adjust, control, or steer the loudspeaker assemblies so that at least one acoustic wave field is generated at least at one listening position.

19 Claims, 8 Drawing Sheets

(51) Int. Cl.

| | |
|---|---|
| ***H04R 1/40*** | (2006.01) |
| ***H04R 5/02*** | (2006.01) |
| ***H04R 5/04*** | (2006.01) |
| ***H04S 3/00*** | (2006.01) |
| ***H04S 3/02*** | (2006.01) |
| ***H04S 7/00*** | (2006.01) |

(52) U.S. Cl.

CPC ..... *H04R 5/04* (2013.01); *H04S 3/002* (2013.01); *H04S 3/02* (2013.01); *H04S 7/30* (2013.01); *H04S 7/303* (2013.01); *G09G 2300/02* (2013.01); *G09G 2360/04* (2013.01); *H04R 2203/12* (2013.01); *H04S 2400/01* (2013.01); *H04S 2420/11* (2013.01)

(56) References Cited

U.S. PATENT DOCUMENTS

| | | | | |
|---|---|---|---|---|
| 6,904,152 | B1 | 6/2005 | Moorer | |
| 8,834,369 | B2 | 9/2014 | Magee | |
| 9,299,353 | B2 | 3/2016 | Sole et al. | |
| 9,432,768 | B1 | 8/2016 | O'Neill et al. | |
| 9,762,999 | B1 * | 9/2017 | Johnson | H04R 1/403 |
| 2003/0147539 | A1 * | 8/2003 | Elko | H04R 5/027 381/92 |
| 2006/0126878 | A1 * | 6/2006 | Takumai | H04R 5/02 381/335 |
| 2006/0239471 | A1 | 10/2006 | Mao et al. | |
| 2006/0262939 | A1 | 11/2006 | Buchner et al. | |
| 2007/0092099 | A1 | 4/2007 | Nakano | |
| 2008/0025534 | A1 | 1/2008 | Kuhn et al. | |
| 2008/0181416 | A1 * | 7/2008 | Jung | H04R 1/403 381/2 |
| 2009/0304205 | A1 | 12/2009 | Hardacker et al. | |
| 2010/0014685 | A1 * | 1/2010 | Wurm | G10K 11/17823 381/71.11 |
| 2011/0038494 | A1 | 2/2011 | Graber | |
| 2011/0096941 | A1 | 4/2011 | Marzetta et al. | |
| 2011/0103620 | A1 | 5/2011 | Strauss et al. | |
| 2011/0316967 | A1 | 12/2011 | Etter | |
| 2012/0020480 | A1 | 1/2012 | Visser et al. | |
| 2012/0087509 | A1 | 4/2012 | Elmedyb et al. | |
| 2012/0185769 | A1 | 7/2012 | Whitley | |
| 2013/0058505 | A1 | 3/2013 | Munch et al. | |
| 2013/0223658 | A1 * | 8/2013 | Betlehem | H04S 3/002 381/307 |
| 2013/0259238 | A1 | 10/2013 | Xiang et al. | |
| 2013/0314610 | A1 | 11/2013 | Yagihashi et al. | |
| 2014/0006017 | A1 | 1/2014 | Sen | |
| 2014/0064526 | A1 * | 3/2014 | Otto | H04S 5/00 381/300 |
| 2014/0098966 | A1 | 4/2014 | Corteel et al. | |
| 2014/0153744 | A1 | 6/2014 | Brannmark et al. | |
| 2014/0294211 | A1 * | 10/2014 | Schneider | H04S 7/301 381/303 |
| 2014/0355769 | A1 | 12/2014 | Peters et al. | |
| 2014/0358557 | A1 | 12/2014 | Sen et al. | |
| 2015/0078594 | A1 | 3/2015 | Mcgrath et al. | |
| 2015/0199953 | A1 * | 7/2015 | Volcker | G10K 11/175 381/17 |
| 2015/0230040 | A1 | 8/2015 | Squires et al. | |
| 2015/0237428 | A1 | 8/2015 | Schneider et al. | |
| 2015/0371659 | A1 * | 12/2015 | Gao | H04M 9/082 704/226 |
| 2015/0382127 | A1 | 12/2015 | Sun et al. | |
| 2016/0021481 | A1 * | 1/2016 | Johnson | H04R 5/04 381/303 |
| 2016/0080886 | A1 | 3/2016 | De Bruijn et al. | |
| 2016/0142851 | A1 | 5/2016 | Sun et al. | |
| 2016/0148624 | A1 | 5/2016 | Jonan et al. | |
| 2016/0295340 | A1 | 10/2016 | Baker et al. | |
| 2016/0353205 | A1 | 12/2016 | Munch | |
| 2017/0034620 | A1 | 2/2017 | Mitsufuji | |
| 2017/0070815 | A1 | 3/2017 | Mitsufuji | |
| 2017/0238090 | A1 * | 8/2017 | Johnson | H04R 1/025 381/335 |

FOREIGN PATENT DOCUMENTS

| | | | | |
|---|---|---|---|---|
| CN | 1956601 | A | 5/2007 | |
| CN | 101217830 | A | 7/2008 | |
| CN | 101288338 | A | 10/2008 | |
| CN | 101588524 | A | 11/2009 | |
| CN | 101640830 | A | 2/2010 | |
| CN | 103069842 | A | 4/2013 | |
| CN | 103491397 | A | 1/2014 | |
| CN | 103635964 | A | 3/2014 | |
| CN | 104349267 | A | 2/2015 | |
| CN | 104954930 | A | 9/2015 | |
| CN | 104956695 | A | 9/2015 | |
| CN | 104980845 | A | 10/2015 | |
| CN | 104980855 | A | 10/2015 | |
| CN | 104980856 | A | 10/2015 | |
| CN | 104980857 | A | 10/2015 | |
| CN | 104980859 | A | 10/2015 | |
| CN | 105075288 | A | 11/2015 | |
| EP | 1662842 | A1 | 5/2006 | |
| EP | 1686830 | A1 | 8/2006 | |
| EP | 1699259 | A1 | 9/2006 | |
| EP | 2930958 | A1 | 10/2015 | |
| JP | H1127604 | A | 1/1999 | |
| JP | 2015126358 | A | 7/2015 | |
| SE | WO-2016028199 | A1 * | 2/2016 | H04S 7/301 |
| WO | 2007113718 | A1 | 10/2007 | |
| WO | 2010116153 | A1 | 10/2010 | |
| WO | 2015076930 | A1 | 5/2015 | |

OTHER PUBLICATIONS

Chinese Office Action for Application No. 201680077698.4 dated Apr. 3, 2020, 9 pgs.

Chinese Office Action for Application No. 201680076971.1 dated Mar. 11, 2020, 8 pgs.

Second Chinese Office Action for Application No. 201680077698.4 dated Dec. 22, 2020, 7 pgs.

English Translation of Japanese Office Action for Application No. 2016-248968 dated Jan. 8, 2021, 8 pgs.

Non-Final Office Action; related U.S. Appl. No. 16/067,897, filed Jul. 3, 2018; dated Jun. 22, 2020; 27 pgs.

Final Office Action; related U.S. Appl. No. 16/067,897, filed Jul. 3, 2018; dated Dec. 15, 2020; 26 pgs.

Non-Final Office Action; related U.S. Appl. No. 16/067,916, filed Jul. 3, 2018; dated Jun. 22, 2020; 18 pgs.

Final Office Action; related U.S. Appl. No. 16/067,916, filed Jul. 3, 2018; dated Dec. 15, 2020; 18 pgs.

Non-Final Office Action; related U.S. Appl. No. 16/067,916, filed Jul. 3, 2018; dated Jun. 18, 2021; 32 pgs.

Non-Final Office Action; related U.S. Appl. No. 16/067,897, filed Jul. 3, 2018; dated Jun. 8, 2021; 28 pgs.

Poletti, M. A., "Three Dimensional Surround Sound Systems Based on Spherical Harmonics*", Nov. 2005, 22 pgs., vol. 53, No. 11, J. Audio Eng. Soc.

Final Office Action; related U.S. Appl. No. 16/067,916, filed Jul. 3, 2018; dated Oct. 13, 2021; 21 pgs.

Final Office Action; related U.S. Appl. No. 16/067,897, filed Jul. 3, 2018; dated Oct. 20, 2021; 25 pgs.

* cited by examiner

LOUDSPEAKER ARRAY

CROSS-REFERENCE TO RELATED APPLICATION

This application is the U.S. national phase of PCT Application No. PCT/EP2016/081014 filed on Dec. 14, 2016, which claims priority to EP Patent Application No. 16150043.4 filed on Jan. 4, 2016, the disclosures of which are incorporated in their entirety by reference herein.

TECHNICAL FIELD

The disclosure relates to loudspeaker arrays and, particularly, to soundbars.

BACKGROUND

Two-dimensional or three-dimensional audio may be realized using a sound field description by a technique called Higher-Order Ambisonics. Ambisonics is a full-sphere surround sound technique which may cover, in addition to the horizontal plane, sound sources above and below the listener. Unlike other multichannel surround formats, its transmission channels do not carry loudspeaker signals. Instead, they contain a loudspeaker-independent representation of a sound field, which is then decoded to the listener's loudspeaker setup. This extra step allows a music producer to think in terms of source directions rather than loudspeaker positions, and offers the listener a considerable degree of flexibility as to the layout and number of loudspeakers used for playback. Ambisonics can be understood as a three-dimensional extension of mid/side (M/S) stereo, adding additional difference channels for height and depth. In terms of First-Order Ambisonics, the resulting signal set is called B-format. The spatial resolution of First-Order Ambisonics is quite low. In practice, that translates to slightly blurry sources, and also to a comparably small usable listening area or sweet spot.

The resolution can be increased and the sweet spot enlarged by adding groups of more selective directional components to the B-format. In terms of Second-Order Ambisonics, these no longer correspond to conventional microphone polar patterns, but look like, e.g., clover leaves. The resulting signal set is then called Second-, Third-, or collectively, Higher-Order Ambisonics (HOA). However, common applications of the HOA technique require, dependent on whether a two-dimensional (2D) and three-dimensional (3D) wave field is processed, specific spatial configurations notwithstanding whether the wave field is measured (decoded) or reproduced (encoded): Processing of 2D wave fields requires cylindrical configurations and processing of 3D wave fields requires spherical configurations, each with a regular distribution of the microphones or loudspeakers. Applicable loudspeaker arrays for two- or three-dimensional audio is highly appreciated.

SUMMARY

A sound reproduction system includes at least two closely spaced identical or similar loudspeaker assemblies in a horizontal linear array, each loudspeaker assembly including at least two identical or similar loudspeakers pointing in different directions so that the loudspeaker assemblies have adjustable, controllable or steerable directivity characteristics. The system further includes a control module configured to drive and to adjust, control or steer the loudspeaker assemblies so that at least one acoustic wave field is generated at least at one listening position.

A sound reproduction method includes reproducing sound at least at two closely spaced loudspeaker positions with identical or similar loudspeaker assemblies in a horizontal linear array, each loudspeaker assembly comprising at least two identical or similar loudspeakers pointing in different directions so that the loudspeaker assemblies have adjustable, controllable or steerable directivity characteristics. The method further includes driving, adjusting, controlling and/or steering the loudspeaker assemblies so that at least one acoustic wave field is generated at least at one listening position.

A horizontal linear loudspeaker array includes at least two closely spaced identical or similar loudspeaker assemblies in a line, each loudspeaker assembly comprising at least two identical or similar loudspeakers pointing in different directions so that the loudspeaker assemblies have adjustable, controllable or steerable directivity characteristics.

Other systems, methods, features and advantages will be, or will become, apparent to one with skill in the art upon examination of the following figures and detailed description. It is intended that all such additional systems, methods, features and advantages be included within this description, be within the scope of the invention, and be protected by the following claims.

BRIEF DESCRIPTION OF THE DRAWINGS

The system, assemblies and methods may be better understood with reference to the following drawings and description. The components in the figures are not necessarily to scale, emphasis instead being placed upon illustrating the principles of the invention. Moreover, in the figures, like referenced numerals designate corresponding parts throughout the different views.

DETAILED DESCRIPTION

Figure 1:
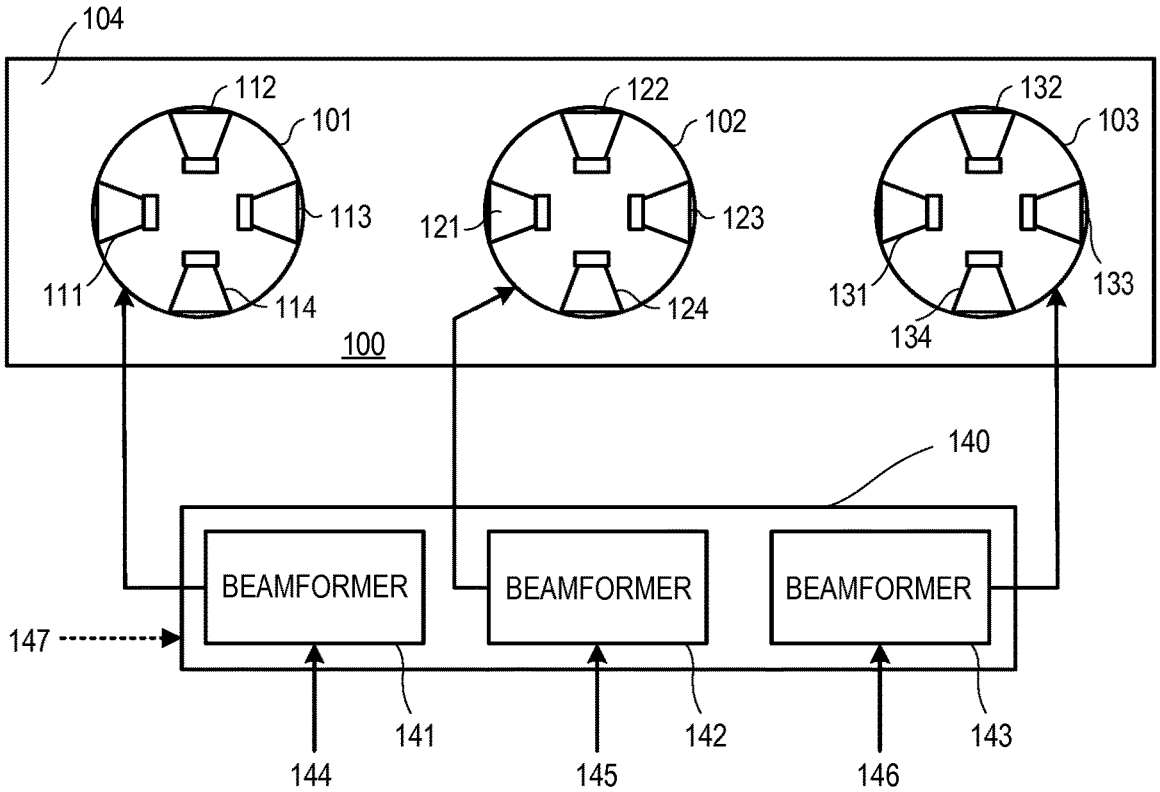
FIG. 1 is a schematic top view illustrating an exemplary soundbar based on three higher-order loudspeaker assemblies for creating a two-dimensional acoustic wave field at a desired position (sweet spot) in a room.
Figure 2:
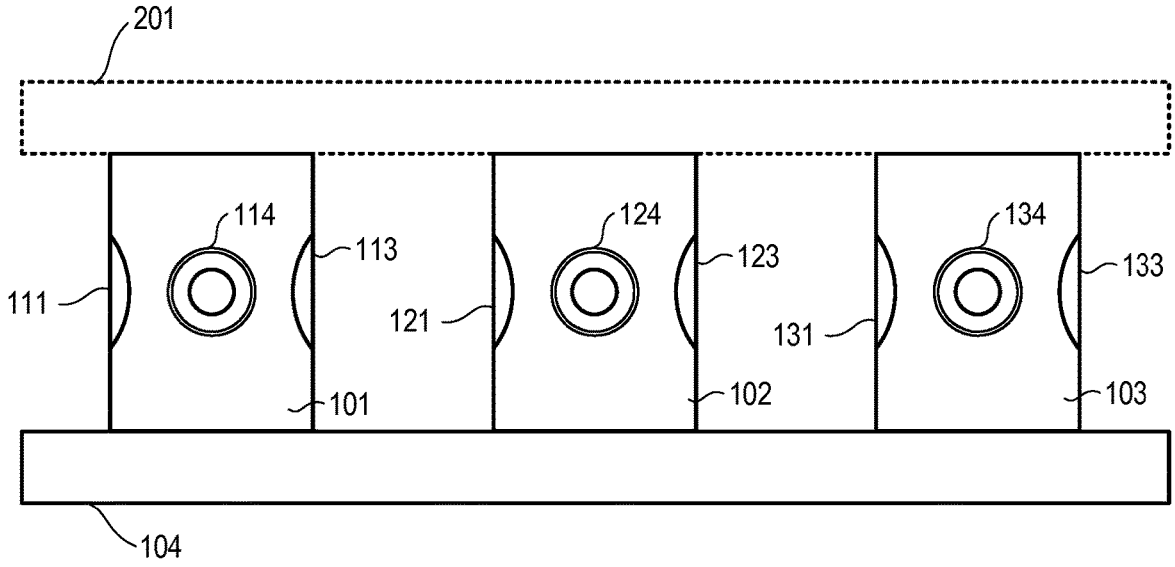
FIG. 2 is a schematic side view illustrating the soundbar shown in FIG. 1.

FIGS. 1 and 2 illustrate a sound reproduction system 100 which includes three (or, if appropriate, only two) closely spaced steerable (higher-order) loudspeaker assemblies 101, 102, 103, here arranged, for example, in a horizontal linear array (which is referred to herein as higher-order soundbar). Loudspeaker assemblies with omnidirectional directivity characteristics, dipole directivity characteristics and/or any higher order polar responses are herein referred to also as higher-order loudspeakers. Each higher-order loudspeaker 101, 102, 103 has adjustable, controllable or steerable directivity characteristics (polar responses) as outlined further below. Each higher-order loudspeaker 101, 102, 103 may include a horizontal circular array of lower-order loudspeakers (e.g., omni-directional loudspeakers). For example, the circular arrays may each include, e.g., four lower-order loudspeakers 111 to 114, 121 to 124, 131 to 134 (such as common loudspeakers and, thus, also referred to as loudspeakers), the four lower-order loudspeakers 111 to 114, 121 to 124, 131 to 134 each directed in one of four perpendicular directions in a radial plane in this example. The array of higher-order loudspeakers 101, 102, 103 may be disposed on an optional base plate 104 and may have an optional top plate 201 on top (e.g., to carry a flat screen TV set). Alternatively, instead of four lower-order loudspeakers only three lower-order loudspeakers per higher-order loudspeaker assembly can be employed to create a two-dimensional higher-order loudspeaker of the first order using Ambisonics technology. Alternative use of the multiple-input multiple-output technology instead of the Ambisonics technology allows for creating a two-dimensional higher-order loudspeaker of the first order even with only two lower-order loudspeakers. Other options include the creation of three-dimensional higher-order loudspeakers with four lower-order loudspeakers that are regularly distributed on a sphere using the Ambisonics technology and with four lower-order loudspeakers that are regularly distributed on a sphere using the multiple-input multiple-output technology. Furthermore, the higher-order loudspeaker assemblies may be arranged other than in a straight line, e.g., on an arbitrary curve in a logarithmically changing distance from each other or in a completely arbitrary, three-dimensional arrangement in a room.

The four lower-order loudspeakers 111 to 114, 121 to 124, 131 to 134 may be substantially the same size and have a peripheral front surface, and an enclosure having a hollow, cylindrical body and end closures. The cylindrical body and end closures may be made of material that is impervious to air. The cylindrical body may include openings therein. The openings may be sized and shaped to correspond with the peripheral front surfaces of the lower-order loudspeakers 111 to 114, 121 to 124, 131 to 134, and have central axes. The central axes of the openings may be contained in one radial plane, and the angles between adjacent axes may be identical. The lower-order loudspeakers 111 to 114, 121 to 124, 131 to 134 may be disposed in the openings and hermetically secured to the cylindrical body. However, additional loudspeakers may be disposed in more than one such radial plane, e.g., in one or more additional planes above and/or below the radial plane described above. Optionally, the lower-order loudspeakers 111 to 114, 121 to 124, 131 to 134 may each be operated in a separate, acoustically closed volume 115 to 118, 125 to 128, 135 to 138 in order to reduce or even prevent any acoustic interactions between the lower-order loudspeakers of a particular higher-order loudspeaker assembly. Furthermore, the lower-order loudspeakers 11 to 114, 121 to 124, 131 to 134 may each be arranged in a dent, hole, recess or the like. Additionally or alternatively, a wave guiding structure such as but not limited to a horn, an inverse horn, an acoustic lens etc. may be arranged in front of the lower-order loudspeakers 111 to 114, 121 to 124, 131 to 134.

A control module 140 receives, e.g., three Ambisonic signals 144, 145, 146 to process the Ambisonic signals 144, 145, 146 in accordance with steering information 147, and to drive and steer the higher-order loudspeakers 101, 102, 103 based on the Ambisonic signals 144, 145, 146 so that at least one acoustic wave field is generated at least at one position that is dependent on the steering information. The control module 140 comprises beamformer modules 141, 142, 143 that drive the lower-order loudspeakers 111 to 114, 121 to 124, 131 to 134. Examples of beamformer modules are described further below.

Figure 3:
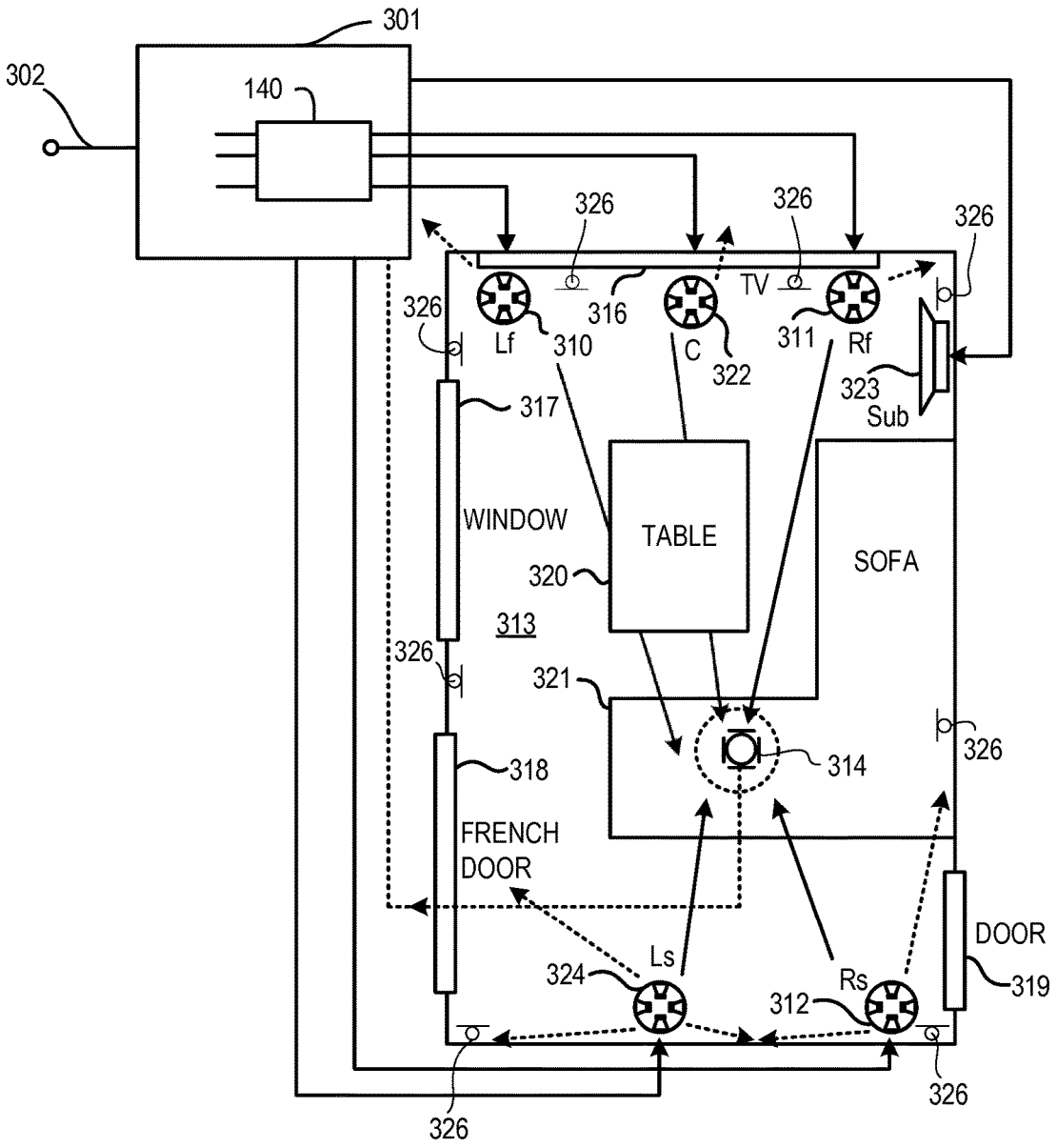
FIG. 3 is a schematic diagram illustrating an exemplary listening environment with one sweet area.

FIG. 3 depicts various possibilities how to use a horizontal linear array of high-order loudspeakers (referred to herein also as horizontal high-order soundbar or just high-order soundbar) in order to realize virtual sound sources in home entertainment. For example, such a linear array may be disposed under a television (TV) set for reproducing e.g. the front channels of the commonly used layout in home cinema, the 5.1 surround sound. The front channels of a 5.1 sound system include a front left (Lf) channel, a front right (Rf) channel and a center (C) channel. Arranging a single high-order loudspeaker underneath the TV set instead of the horizontal high-order soundbar would mean that the C channel could be directed to the front of the TV set and the Lf and Rf channels to its sides, so that the Lf and Rf channels would not be transferred directly to a listener sitting (at sweet spot or sweet area) in front of the TV set but only indirectly via the side walls, constituting a transfer path which depends on a lot of unknown parameters and, thus, can hardly be controlled. Therefore, in a multi-channel system with at least two channels to be reproduced a high-order soundbar with (at least) two high-order loudspeakers that are arranged in a horizontal line allows for directly transferring front channels, e.g., the Lf and Rf channels, directly to the sweet area, i.e., the area where the listener should be.

Furthermore, a center channel, e.g., the C channel, may be reproduced at the sweet area by way of two high-order loudspeakers. Alternatively, a third high-order loudspeaker, disposed between the two high-order loudspeakers, may be used to separately direct the Lf and Rf channels and the C channel to the sweet area. Since with three high-order loudspeakers each channel is reproduced by a separate unit, the spatial sound impression of a listener at the sweet area can be further improved. Furthermore, with each additional high-order loudspeaker added to the high-order soundbar a more diffuse sound impression can be realized and further channels such as, e.g., effect channels may be radiated from the rear side of the high-order soundbar, which is in the present example from the rear side of the TV set to, e.g., the rear wall where the sound provided by the effect channels is diffused.

In contrast to common soundbars in which the lower-order loudspeakers are arranged in line, higher-order soundbars provide more options for the positioning of the directional sound sources, e.g., on the side and rear, so that in a common listening environment such as a living room, a directivity characteristic that is almost independent from the spatial direction can be achieved with higher-order soundbars. For example, a common side bar having 14 lower-order loudspeaker equidistantly distributed inline over a distance of 70 cm can only generate virtual sound sources in an area of maximum ±90° (degree) from the front direction, while higher-order soundbars allow for virtual sound sources in an area of ±180°.

FIG. 3 illustrates an exemplary set-up with a higher-order soundbar including three higher-order loudspeaker 310, 311, 322. A sound system 301 receiving one or more audio signals 302 and including a control module such as control module 140 shown in FIG. 1 drives the three higher-order loudspeaker 310, 311, 322 in a target room 313, e.g., a common living room. At a listening position or sweet area (represented by a microphone array 314), the wave field of at least one desired virtual source can then be generated. In the target room 313, further higher-order loudspeakers, e.g., a higher-order loudspeaker 324 for a rear left (Ls) channel, a lower-order sub-woofer 323 for the low frequency effects (Sub) channel, and a higher-order loudspeaker 312 for a rear right (Rs) channel are arranged. The target room 313 is acoustically very unfavorable as it includes a window 317 and a French door 318 in the left wall and a door 319 in the right wall in an unbalanced configuration. Furthermore, a sofa 321 is disposed at the right wall and extends approximately to the center of the target room 313 and a table 320 is arranged in front of the sofa 321.

A television set 316 is arranged at the front wall (e.g., above the higher order soundbar) and in line of sight of the sofa 321. The front left (Lf) channel higher-order loudspeaker 310 and the front right (Rf) channel higher-order loudspeaker 311 are arranged under the left and right corners of the television set 316 and the center (C) higher-order loudspeaker 322 is arranged below the middle of television set 316. The low frequency effects (Sub) channel loudspeaker 323 is disposed in the corner between the front wall and the right wall. The loudspeaker arrangement on the rear wall, including the rear left (Ls) channel higher-order loudspeaker 324 and the rear right (Rs) channel under loudspeaker 312, do not share the same center line as the loudspeaker arrangement on the front wall including the front left (Lf) channel loudspeaker 310, the front right (Rs) channel loudspeaker 311, and low frequency effects (Sub) channel loudspeaker 323. An exemplary sweet area 314 may be on the sofa 321 with the table 320 and the television set 316 in front. As can be seen, the loudspeaker setup shown in FIG. 3 is not based on a cylindrical or spherical base configuration and employs no regular distribution.

In the set-up shown in FIG. 3, the main directions are depicted as solid arrows and the sub-directions are depicted as dotted arrows. As depicted, not only precise stereo impressions but also natural, wide staging can be achieved. If further (higher-order) loudspeakers are used, e.g., for the surround channels Ls and Rs, behind the sweet area and in front of the rear wall, or somewhere above (not shown) the level of the soundbar, the surround impression can be further enhanced. Furthermore, it has been found that the number of (lower-order) loudspeakers can be significantly reduced. For example, with five virtual sources of 4th order surrounding the sweet area, wave fields can be approximated similar to those achieved with 45 lower-order loudspeakers surrounding the sweet area, or, in the exemplary environment shown in FIG. 3, a higher-order soundbar with three higher-order loudspeakers, which is built from 12 lower-order loudspeakers in total, and exhibits a better spatial sound impression than with the common soundbar with 14 lower-order loudspeakers in line at comparable dimensions of the two soundbars.

If effect channels or surround channels (e.g., the Ls and Rs channels) are to be disposed between the sweet area and the rear wall, where not sufficient room may be available, higher-order loudspeaker may be implemented as "bulbs" with the same sockets as light bulbs. Such bulb-type higher-order loudspeakers may provide not only sound, but also light in connection with space-saving light emitting diodes. The power required for the bulb-type higher-order loudspeakers (including signal processing and amplifying circuitry) can be supplied via the mains as with common light bulbs. Signals to be reproduced (and others if required) may be provided via a wired (e.g., power-line) or wireless connection such as Bluetooth or WLAN.

Figure 4:
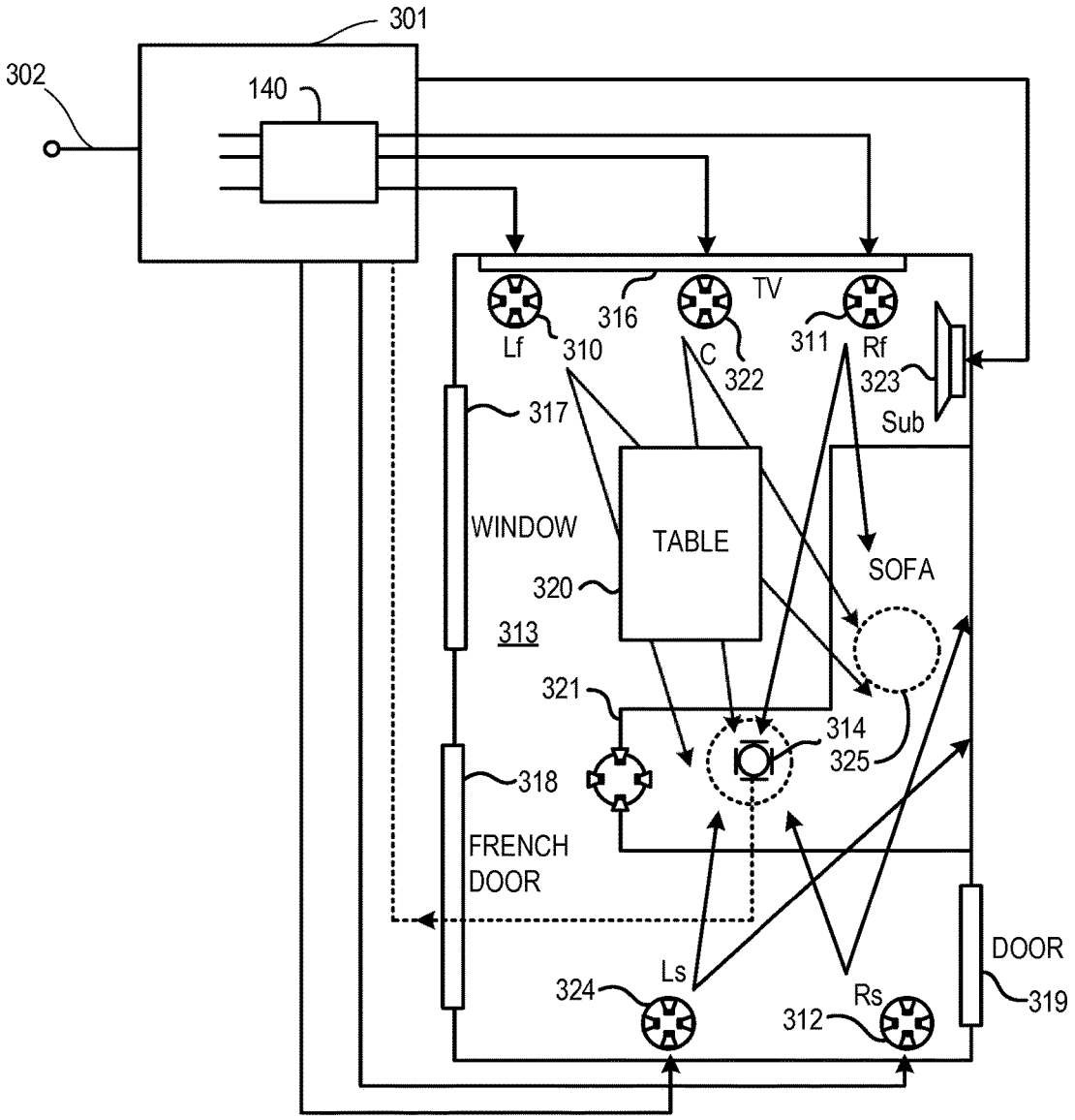
FIG. 4 is a schematic diagram illustrating an exemplary listening environment with two sweet areas.

By way of a set-up similar to that shown in FIG. 3 other sweet areas may be established besides sweet area 325 depicted in FIG. 4. For example, sweet area 325 may receive direct sound beams from the soundbar to allow the same acoustic impressions as those at the sweet area 314 or, alternatively, to reproduce a different acoustic content. Different acoustic content may be in connection with split screen TV sets or separate TV sets (not shown) in the room.

Figure 5:
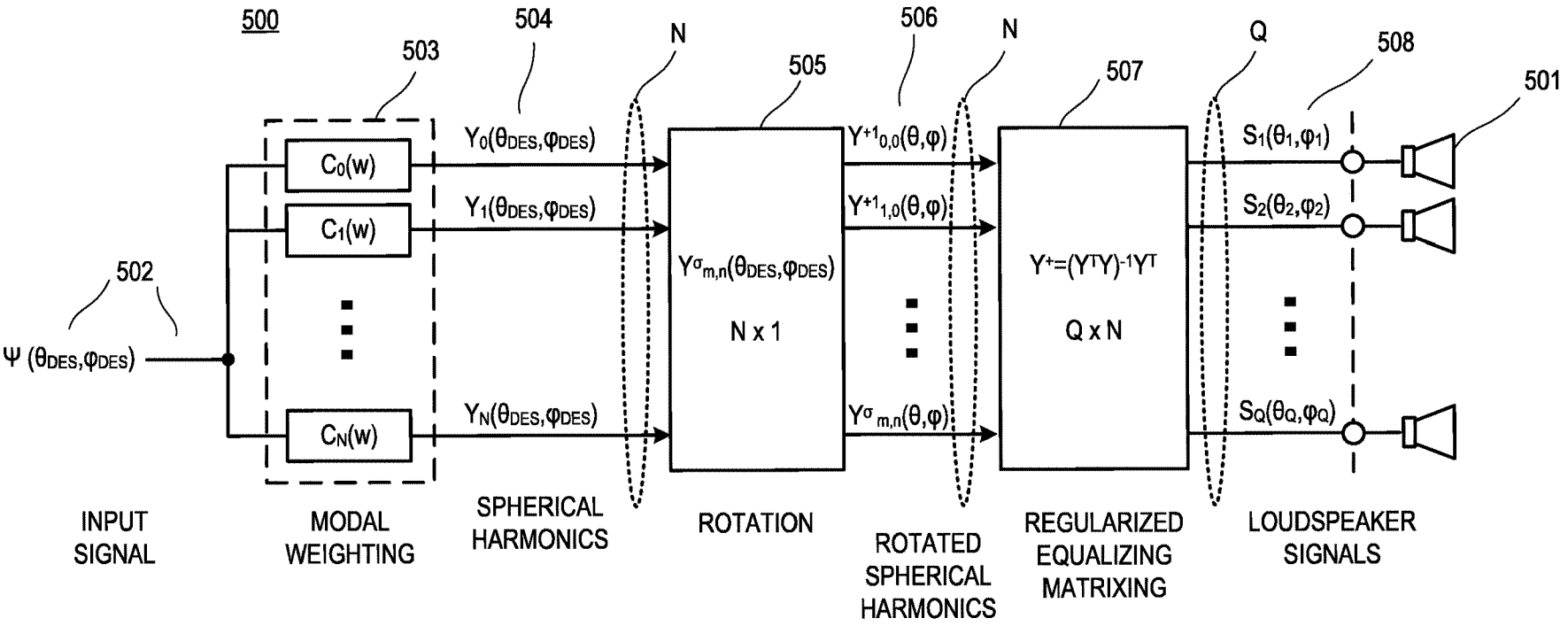
FIG. 5 is a signal flow chart illustrating an exemplary modal beamformer employing a weighting matrix for matrixing.
Figure 6:
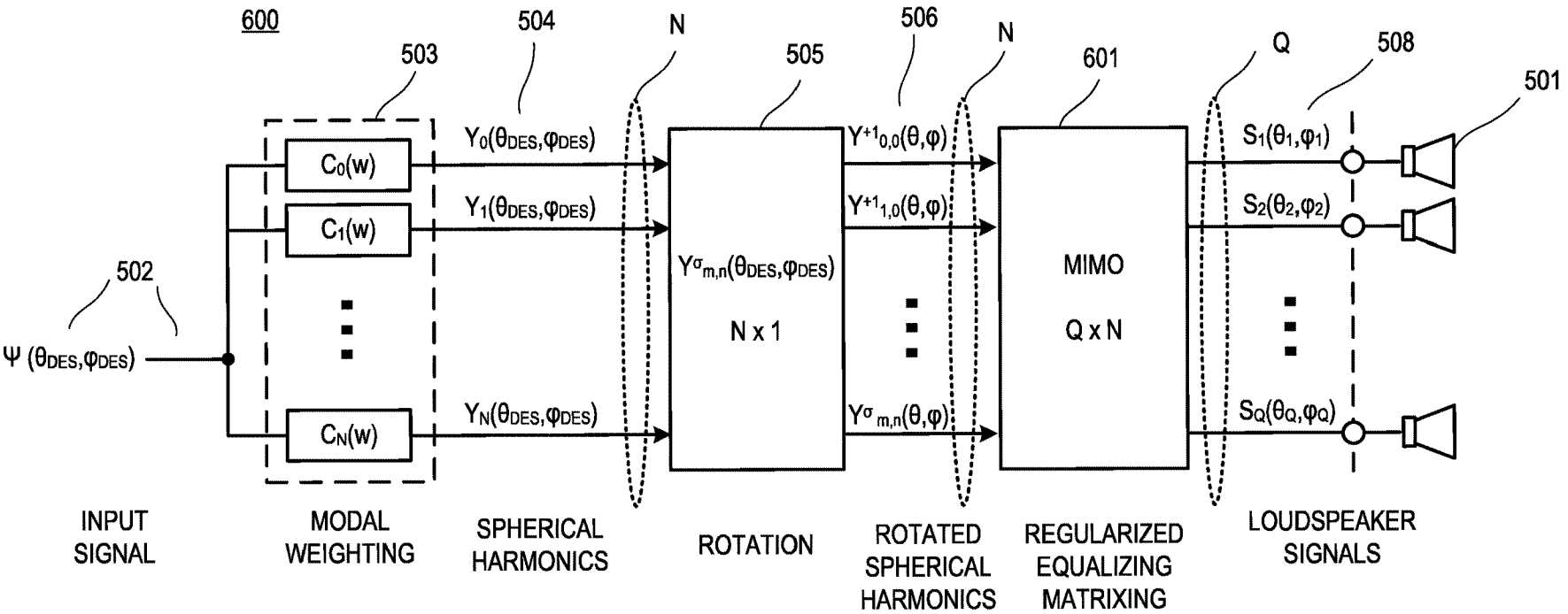
FIG. 6 is a signal flow chart illustrating an exemplary modal beamformer employing a multiple-input multiple-output module for matrixing.

For each of the higher-order loudspeakers of the soundbar (and the other higher-order loudspeakers) a beamformer module 500 or 600 as depicted in FIGS. 5 and 6 (e.g., applicable as beamformers 141, 142, 143 in FIGS. 1 and 2) may be employed. The beamforming module 500 shown in FIG. 5 controls a loudspeaker assembly with Q loudspeakers 501 (or Q groups of loudspeakers each with a multiplicity of loudspeakers such as tweeters, mid-frequency range loudspeakers and/or woofers) dependent on N (Ambisonics) input signals 502, also referred to as input signals x(n) or Ambisonic signals $Y_{n,m}^{\sigma}(\theta, \varphi)$ with m representing the order and n representing the grade, wherein for two dimensions N is $N_{2D}=(2M+1)$ and for three dimensions $N_{3D}=(M+1)^2$. The beamforming module 500 may further include a modal weighting sub-module 503, a dynamic wave-field manipulation (e.g., rotation) sub-module 505, a regularized equalizing matrixing sub-module 507. The modal weighting sub-module 503 is supplied with the input signal 502 which is weighted with modal weighting coefficients, i.e., filter coefficients $C_0(\omega)$, $C_1(\omega)$ . . . $C_N(\omega)$ in the modal weighting sub-module 503 to provide a desired beam pattern, i.e., radiation pattern $\psi_{Des}(\theta, \omega)$ based on the N spherical harmonics $Y_{n,m}^{\sigma}(\theta, \varphi)$ to deliver N weighted Ambisonic signals 504, also referred to as $C_{n,m}^{\sigma}\ Y_{n,m}^{\sigma}\ (\theta, \varphi)$. The weighted Ambisonic signals 504 are transformed by the dynamic wave-field manipulation sub-module 505 using N×1 weighting coefficients, e.g. to rotate the desired beam pattern $\psi_{Des}(\theta, \varphi)$ to a desired position $\Theta_{Des}$, $\varphi_{Des}$. Thus N modified (e.g., rotated, focused and/or zoomed) and weighted Ambisonic signals 506, also referred to as $C_{n,m}^{\sigma}\ Y_{n,m}^{\sigma}\ (\theta_{Des}, \varphi_{Des})$, are output by the dynamic wave-field manipulation sub-module 505. The N modified and weighted Ambisonic signals 506 are then input into the regularized equalizing matrixing sub-module 507, which includes a radial equalizing filter for considering the susceptibility of the playback device Higher-Order-Loudspeaker (HOL) preventing e.g. a given White-Noise-Gain (WNG) threshold from being undercut. In the regularized equalizing matrixing sub-module 507, outputs of the regularization are transformed, e.g. by pseudo-inverse $Y^{+}=(Y^{T}Y)^{-1}Y^{T}$, which simplifies to $$Y^{+} = \frac{1}{Q} Y^{T},$$

if the Q lower-order loudspeakers are arranged at the body of the higher-order loudspeakers in a regular fashion, into the modal domain and subsequently into Q loudspeaker signals 508 by the matrixing with a N×Q weighting matrix as shown in FIG. 5. Alternatively, the Q loudspeaker signals 508 may be generated from the N regularized, modified and weighted Ambisonic signals 510 by a multiple-input multiple-output sub-module 601 using an N×Q filter matrix as shown in FIG. 6. The systems shown in FIGS. 5 and 6 may be employed to realize two-dimensional or three-dimensional audio using a sound field description such as Higher-Order Ambisonics.

An example of a simple Ambisonic panner (or encoder) takes an input signal, e.g., a source signal s and two parameters, the horizontal angle θ and the elevation angle φ. It positions the source at the desired angle by distributing the signal over the Ambisonic components with different gains for the corresponding Ambisonic signals W ($Y_{0,0}^{+1}(\theta, \varphi)$), X ($Y_{1,1}^{+1}(\theta, \varphi)$), Y ($Y_{1,1}^{-1}(\theta, \varphi)$) and Z ($Y_{1,0}^{+1}(\theta, \varphi)$):

$$w = s \cdot \frac{1}{\sqrt{2}},$$

$$x = s \cdot \cos\theta \cdot \cos\varphi,$$

$$y = s \cdot \sin\theta \cdot \cos\varphi, \quad \text{and}$$

$$z = s \cdot \sin\varphi.$$

Being omnidirectional, the W channel always delivers the same signal, regardless of the listening angle. In order that it has more-or-less the same average energy as the other channels, W is attenuated by w, i.e., by about 3 dB (precisely, divided by the square root of two). The terms for X, Y, Z may produce the polar patterns of figure-of-eight. Taking their desired weighting values at angles θ and φ(x, y, z), and multiplying the result with the corresponding Ambisonic signals (X, Y, Z), the output sums end up in a figure-of-eight radiation pattern pointing now to the desired direction, given by the azimuth θ and elevation φ, utilized in the calculation of the weighting values x, y and z, having an energy content that can cope with the W component, weighted by w. The B-format components can be combined to derive virtual radiation patterns that can cope with any first-order polar pattern (omnidirectional, cardioid, hypercardioid, figure-of-eight or anything in between) and point in any three-dimensional direction. Several such beam patterns with different parameters can be derived at the same time to create coincident stereo pairs or surround arrays.

Figure 7:
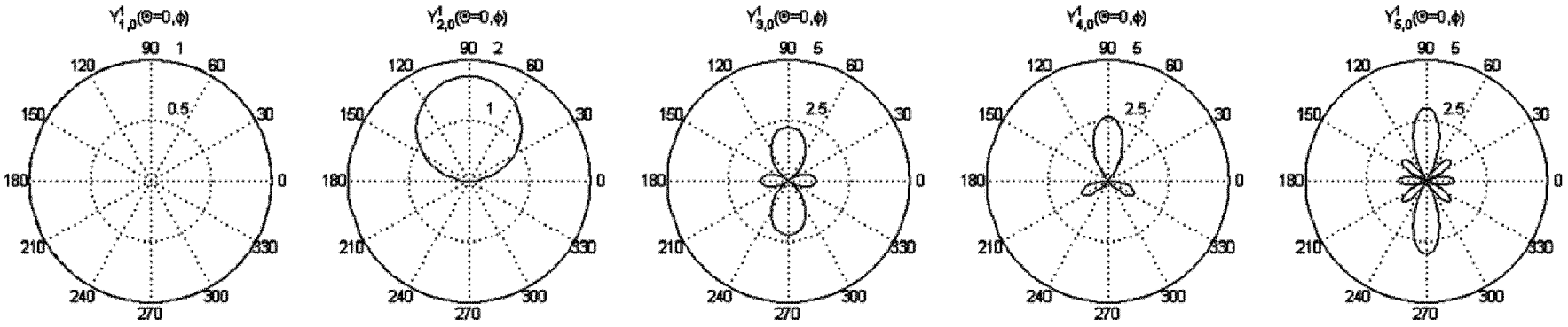
FIG. 7 is a two-dimensional depiction of the real parts of the spherical harmonics up to an order of M=4 in Z direction.

Referring now to FIG. 7, higher-order loudspeakers or loudspeaker assemblies like those described above in connection with FIGS. 1 to 4, including beamformer modules such as those shown in FIGS. 5 and 6, allow for approximating any desired directivity characteristic by superimposing the basic functions, i.e., the spherical harmonics. FIG. 7 is a two-dimensional depiction (magnitudes vs. degrees) of the real spherical harmonics with orders of M=0 to 4 in the Z direction of the exemplary higher-order loudspeaker described above.

Figure 8:
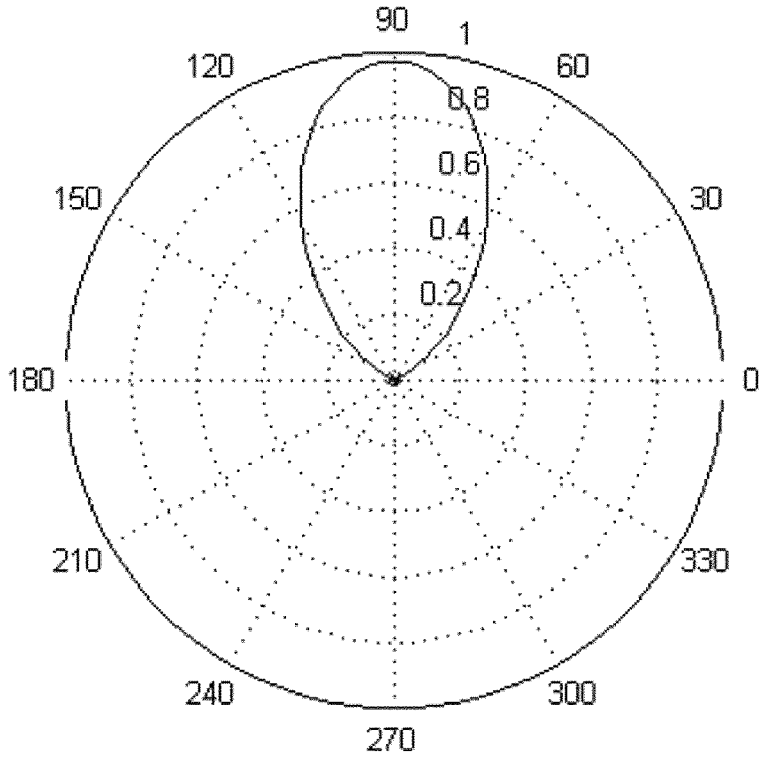
FIG. 8 is a diagram illustrating the directivity characteristic of a cardioid radiation pattern of 9th order.
Figure 9:
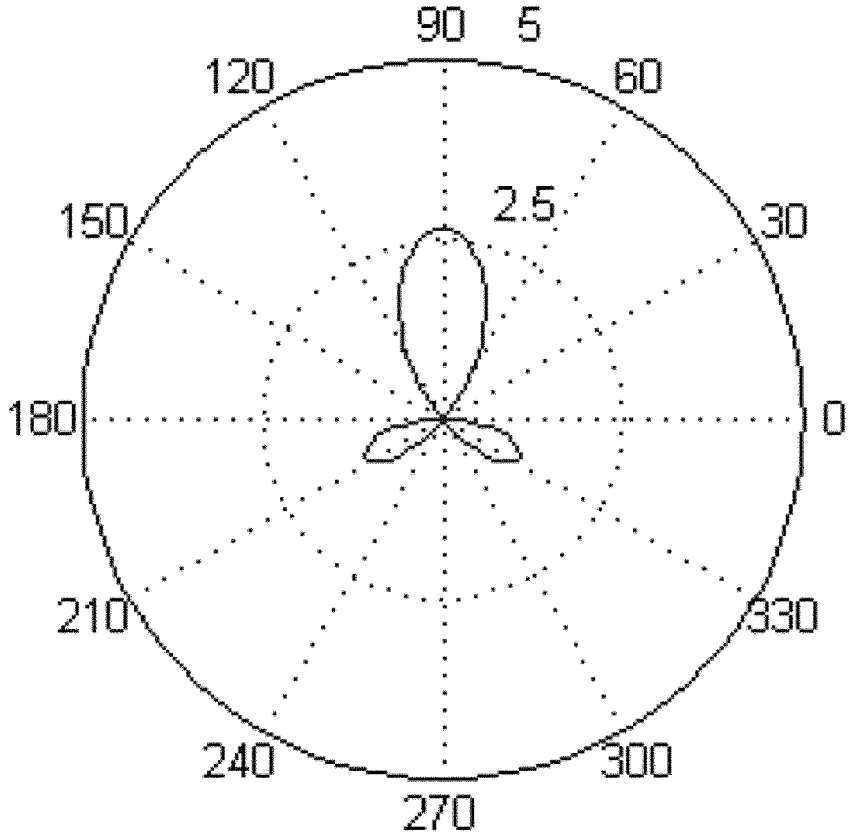
FIG. 9 is a diagram illustrating the directivity characteristic of the real part of the spherical harmonic of third order.

For example, when superimposing the five basic functions depicted in FIG. 7 using modal weighting coefficients $C_m$=[0.100, 0.144, 0.123, 0.086, 0.040], wherein m=[0 . . . 4], a directivity characteristic of an approximated cardioid of 9th order can be generated as shown in FIG. 8. Whereas, when superimposing the five basic functions depicted in FIG. 7 using modal weighting coefficients $C_m$=[0.000, 0.000, 0.000, 1.000, 0.040], wherein again m=[0 . . . 4], a directivity characteristic of the real part of the spherical harmonic of third order in Z direction can be generated as shown in FIG. 8.

The matrixing module 601 may be implemented as a multiple-input multiple-output system that provides an adjustment of the output signals of the higher-order loudspeakers so that the radiation patterns approximate as closely as possible the desired spherical harmonics, as shown e.g. in FIG. 7. To generate a desired wave-field at a certain position or area in the room utilizing several higher-order loudspeakers, it may be sufficient in the adaptation process to adapt only the modal weights $C_{n,m}^{\sigma}$ of the individual higher-order loudspeakers employed, i.e. to run the adaptation directly in the wave domain. Because of this adaptation in the wave field domain, such a process is called Wave-Domain Adaptive Filtering (WDAF). WDAF is a known efficient spatio-temporal generalization of the also known Frequency-Domain Adaptive Filtering (FDAF). Through the incorporation of the mathematical foundations on wave fields, WDAF is suitable even for massive multiple-input multiple-output systems with highly cross-correlated broadband input signals. With wave domain adaptive filtering the directional characteristics of the higher-order loudspeakers are adaptively determined so that the superpositions of the individual sound beams in the sweet area(s) approximate the desired sound wave field.

To adjust or (singularly or permanently) adapt the sound reproduced by the soundbar to the specific room conditions and the specific requirements of the sweet area of the loudspeaker set-up, which includes the high-order soundbar and, possibly, other (high-order) loudspeakers, the wave field needs to be measured and quantified. This may be accomplished by way of an array of microphones (microphone array) and a signal processing module able to decode the given wave-field, that, e.g., form a higher-order Ambisonic system to determine the wave field in three dimensions or, which may be sufficient in many cases, in two dimensions, which requires fewer microphones. For the measurement of a two-dimensional wave field, S microphones are required to measure sound fields up to the Mth order, wherein S=2M+1. In contrast, for a three-dimensional wave field, $S=(2M+1)^2$ microphones are required. Furthermore, in many cases it is sufficient to dispose the microphones (equidistantly) on a circle line. The microphones may be disposed on a rigid or open sphere or cylinder, and may be operated, if needed in connection with an Ambisonic decoder. In an alternative example, the microphone array 314 may be integrated in one of the higher-order loudspeakers (not shown).

Furthermore, a master-slave loudspeaker set-up may be employed. The master unit may include a higher-order soundbar, a microphone array, and a signal processing and steering module. The slave unit(s) may include (a) further higher-order loudspeaker(s) electrically connected (wired or wireless) to the master unit. The microphone array may be detachable, so that it can be used standing alone to conduct the measurements, e.g., in connection with a battery driven power supply and a wireless connection to the master unit. When the microphone array is attached to the master unit again it can be used for other tasks such as speech control of the audio system (e.g., volume control, content selection), or hands-free operation of a telephone interface (e.g., a teleconference system) including adapting (steering) the speaker. The sound reproduction system may also include a DOA module for determining the direction of arrival (DOA) of a sound wave, which, in this application would suffice to be purely triggered by speech signals, i.e., no optical DOA detection is required.

Figure 10:
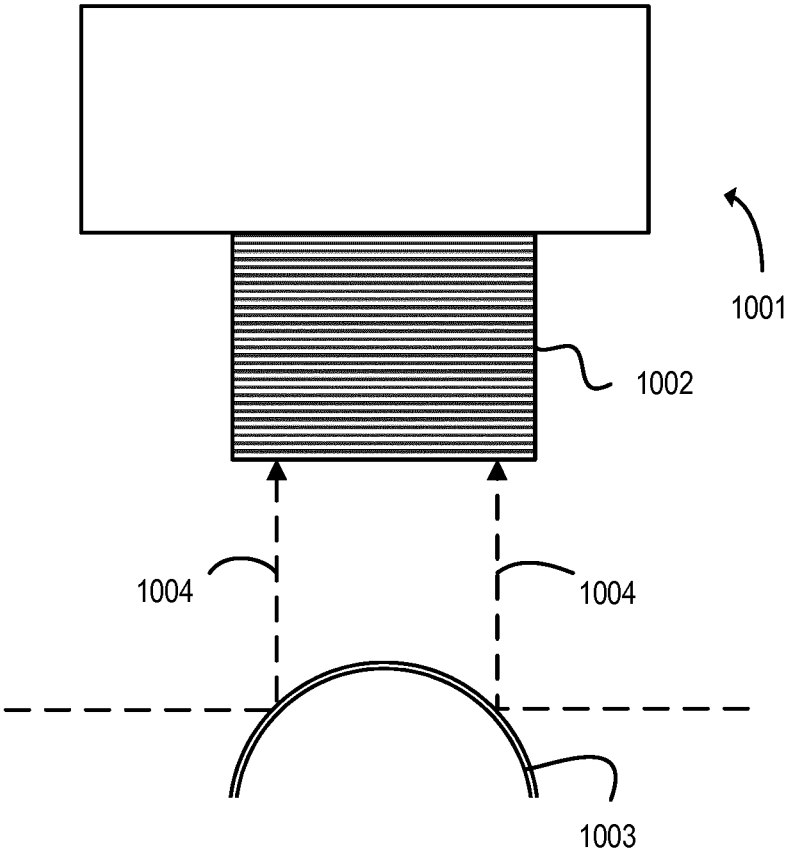
FIG. 10 is a schematic diagram illustrating an exemplary optical detector for determining the direction of arrival of sound waves.

The DOA module may include one or more optical detectors such as one or more cameras to detect the position of a listener and to reposition the sweet area by steering the direction of the higher-order loudspeakers. In this case an optical DOA detector, optionally in combination with the previously mentioned purely speech triggered DOA detection, is necessary since now the sound-field should be adjusted in respect to the current position of the listener, which by no means implies that the person has to talk. An exemplary optical detector is shown in FIG. 10. As shown, a camera 1001 with a lens 1002 may be disposed in an appropriate distance above (or below) a mirrored hemisphere 1003 with the lens 1002 pointing to the curved, mirrored surface of the hemisphere 1003, and may provide a 360° view 1004 in a horizontal plane. For example, when such a detector is mounted in the listening room, the position of the listener can be spotted everywhere in the room. Alternatively, a so-called fisheye lens may be used (as lens 1002) that also provides a 360° view in a horizontal plane when mounted, e.g., to the ceiling of the room, so that the mirrored hemisphere 1003 can be omitted.

By using an array of higher-order loudspeakers (e.g., in form of a higher-order soundbar), each of them having a versatile directivity, arbitrary wave fields can be approximated, even in reflective venues such as living rooms where typically home audio systems are installed. This is possible because, due to the use of higher-order loudspeakers, versatile directivities can be created, radiating the sound only in directions where no reflective surfaces exists, or deliberately making use of certain reflections if those turn out to positively contribute in the creation of a desired wave field to be approximated. Thereby the approximation of the desired wave field at a desired position within the target room (e.g. a certain region at the couch in the living room) can be achieved by using adaptive methods, such as an adaptive multiple-input multiple-output (MIMO) system, given e.g. by the multiple-FXLMS filtered input least mean squared (multiple-FXLMS) algorithm, which could also operate not just in the time or spectral domain, but also in the so-called wave-domain.

Utilizing wave domain adaptive filters (WDAF) is of special interest, since this promises very good results in the approximation of the desired wave field. WDAF can be used if the recording device fulfills certain requirements. For example, circular (for 2D) or spherical microphone arrays (3D), equipped with regularly distributed microphones at the surface, may be used to record the wave field, having, depending on the desired order in which the wave field has to be recorded, respectively reproduced a number of microphones that have to be chosen accordingly. But if beamforming filters are calculated using e.g. a MIMO system, arbitrary microphone arrays having different shapes and microphone distributions can be used as well to measure the wave field, leading to a high flexibility in the recording device. The recording device can be integrated in a main unit of the complete new acoustic system. Thereby it cannot only be used for the already mentioned recording task, but also for other needed purposes, such as enabling a speech control of the acoustic system to verbally control e.g. the volume, switching titles, and so on. Further, the main unit to which the microphone array is attached could also be used as stand-alone device e.g. as teleconferencing hub or as portable music device with the ability to adjust the acoustic in dependence of the relative position of the listener to the device, which is only possible if a video camera is integrated in the main unit as well With the help of arrays of higher-order loudspeakers it is possible to create wave fields of the same quality, but with fewer devices as compared with ordinary loudspeakers. An array of higher-order loudspeakers can be used to create an arbitrary wave field in real, e.g., reflective environments. The necessary recording device (microphone array) can be of arbitrary shape and microphone distribution if special beamforming concepts are used, which can be achieved e.g. by using a suitable adaptive MIMO system, such as the multiple-FXLMS algorithm. This new concept is able to create a much more realistic acoustic impression, even in reflective environments as is given in living rooms.

The description of embodiments has been presented for purposes of illustration and description. Suitable modifications and variations to the embodiments may be performed in light of the above description. The described assemblies, systems and methods are exemplary in nature, and may include additional elements or steps and/or omit elements or steps. As used in this application, an element or step recited in the singular and proceeded with the word "a" or "an" should be understood as not excluding plural of said elements or steps, unless such exclusion is stated. Furthermore, references to "one embodiment" or "one example" of the present disclosure are not intended to be interpreted as excluding the existence of additional embodiments that also incorporate the recited features. The terms "first," "second," and "third," etc. are used merely as labels, and are not intended to impose numerical requirements or a particular positional order on their objects. A signal flow chart may describe a system, method or software implementing the method dependent on the type of realization. e.g., as hardware, software or a combination thereof. A module may be implemented as hardware, software or a combination thereof.

The invention claimed is:

1. A sound reproduction system comprising:

at least two similar loudspeaker assemblies in a horizontal linear array, each similar loudspeaker assembly comprising at least two similar loudspeakers pointing in different directions so that the at least two similar loudspeaker assemblies have controllable or steerable directivity characteristics; and a control module including a modal beamformer and being configured to control and/or steer the at least two similar loudspeaker assemblies so that at least one acoustic wave field is generated at least at one listening position, wherein the modal beamformer includes a modal weighing block that transmits one or more Ambisonic weighted signals in response to Ambisonic input signals to provide a desired beam pattern; and a regularized equalizing matrixing module including a radial equalizing filter programmed to receive the one or more Ambisonic weighted signals and to generate loudspeaker signals based on the one or more Ambisonic weighted signals that exceeds a white-noise-gain (WNG) threshold.

2. The sound reproduction system of claim 1, wherein each similar loudspeaker assembly comprises a horizontal circular array of loudspeakers, and the control module comprises beamformer modules that drive the at least two similar loudspeakers of each similar loudspeaker assembly.

3. The sound reproduction system of claim 2, wherein at least one circular array comprises four loudspeakers, the four loudspeakers pointing in four perpendicular directions.

4. The sound reproduction system of claim 1, wherein the modal beamformer comprises a matrixing module that includes a multiple-input multiple output (MIMO) filter matrix.

5. The sound reproduction system of claim 4, wherein the MIMO filter matrix comprises adaptive filters.

6. The sound reproduction system of claim 5, wherein the adaptive filters are configured to operate according to a filtered input least mean squared algorithm.

7. The sound reproduction system of claim 5, wherein the MIMO filter matrix is configured to operate in a time domain, a spectral domain or a wave domain.

8. The sound reproduction system of claim 5, wherein the adaptive filters are operatively connected to a circular microphone array with at least two microphones that circumvent at the at least one listening position or are disposed at the at least one listening position.

9. The sound reproduction system of claim 1, wherein the control module is operatively connected to a camera and further configured to detect a position of at least one listener and to steer the at least one acoustic wave field to the position of the at least one listener.

10. The sound reproduction system of claim 1, wherein the control module is operatively connected to additional loudspeaker assemblies at least at one other position within a circular microphone array and/or outside a horizontal linear array.

11. The sound reproduction system of claim 1, wherein:

the control module is configured to control or steer the at least two similar loudspeaker assemblies so that at least two acoustic wave fields are generated at least at two listening positions; and at least one acoustic wave field is steered dependent on another acoustic wave field.

12. A sound reproduction method comprising:

reproducing sound at least at loudspeaker positions with identical loudspeaker assemblies in a horizontal linear array, each identical loudspeaker assembly comprising at least two identical loudspeakers pointing in different directions so that the identical loudspeaker assemblies have adjustable or steerable directivity characteristics;

adjusting and/or steering the identical loudspeaker assemblies so that at least one acoustic wave field is generated at least at one listening position;

transmitting, via a modal beamformer including a modal weighting block, one or more Ambisonic weighted signals in response to Ambisonic input signals to provide a desired beam pattern; and receiving, at a regularized equalizing matrixing module including a radial equalizing filter, the one or more Ambisonic weighted signals to generate loudspeaker signals based on the one or more Ambisonic weighted signals that exceed a white-noise-gain (WNG) threshold.

13. A sound reproduction system comprising:

at least two identical loudspeaker assemblies in a horizontal linear array, each identical loudspeaker assembly comprising at least two identical loudspeakers pointing in different directions so that the identical loudspeaker assemblies have controllable or steerable directivity characteristics; and a control module including a modal beamformer configured to drive, adjust and/or steer the at least two identical loudspeaker assemblies so that at least one acoustic wave field is generated at least at one listening position, wherein the modal beamformer includes a modal weighing block that transmits one or more Ambisonic weighted signals in response to Ambisonic input signals to provide a desired beam pattern, and a regularized equalizing matrixing module including a radial equalizing filter programmed to receive the one or more Ambisonic weighted signals and to generate loudspeaker signals based on the one or more Ambisonic weighted signals that exceed a white-noise-gain (WGN) threshold.

14. The sound reproduction system of claim 13, wherein each identical loudspeaker assembly comprises a horizontal circular array of loudspeakers, and the control module comprises beamformer modules that drive the at least two identical loudspeakers of each identical loudspeaker assembly.

15. The sound reproduction system of claim 14, wherein at least one circular array comprises four loudspeakers, the four loudspeakers pointing in four perpendicular directions.

16. The sound reproduction system of claim 13, wherein the control module comprises a modal beamformer.

17. The sound reproduction system of claim 1 further comprising:

an array of S microphones to capture a wave field in audio transmitted by the at least two similar loudspeakers in response to the loudspeaker signals, and a signal processor programmed to decode an n-dimensional wave field to determine the wave field in n dimensions, wherein a measurement of the n-dimensional wave field is based at least on $S=2M+1$, where M corresponds to measured sound fields.

18. The sound reproduction method of claim 12 further comprising:

capturing, via an array of S microphones, a wave field in audio transmitted by the at least two identical loudspeakers in response to the loudspeaker signals, and a signal processor programmed to decode an n-dimensional wave field to determine the wave field in n dimensions, wherein a measurement of the n-dimensional wave field is based at least on $S=2M+1$, where M corresponds to measured sound fields.

19. The sound reproduction system of claim 13 further comprising:

an array of S microphones to capture a wave field in audio transmitted by the at least two identical loudspeakers in response to the loudspeaker signals, and a signal processor programmed to decode an n-dimensional wave field to determine the wave field in n dimensions, wherein a measurement of the n-dimensional wave field is based at least on $S=2M+1$, where M corresponds to measured sound fields.

* * * * *